US005862692A

United States Patent [19]

Legault et al.

[11] Patent Number: 5,862,692

[45] Date of Patent: Jan. 26, 1999

[54] SAFE DOOR LOCK WITH SERVO MOTOR OPERATED CAM

[75] Inventors: Stéphane Legault; Claude Legault, both of Pierrefonds; Pierre Deguire, Kanata, all of Canada

[73] Assignee: C.L. Industries, Inc., Quebec, Canada

[21] Appl. No.: 730,312

[22] Filed: Oct. 11, 1996

[51] Int. Cl.[6] ..... E05B 49/00

[52] U.S. Cl. ..... 70/278; 70/303 A; 70/333 R; 70/475

[58] Field of Search ..... 70/277, 278, 303 A, 70/303 R, 472, 475, 327, 141; 109/59 R; 292/144, 201

[56] References Cited

U.S. PATENT DOCUMENTS

| | | | |
|---|---|---|---|
| 3,733,861 | 5/1973 | Lester | 70/333 R |
| 4,135,377 | 1/1979 | Kleefeldt et al. | 292/144 |
| 4,148,092 | 4/1979 | Martin | 70/278 |
| 4,438,962 | 3/1984 | Soloviff et al. | 292/144 |
| 4,455,552 | 6/1984 | Greiner et al. | 70/333 R |
| 4,745,784 | 5/1988 | Gartner | 70/303 A |
| 5,249,831 | 10/1993 | Maniaci | 292/144 |
| 5,542,272 | 8/1996 | Heinemann | 70/277 |
| 5,592,838 | 1/1997 | Clark | 70/333 R |

FOREIGN PATENT DOCUMENTS

| | | | |
|---|---|---|---|
| 0333588 | 9/1989 | European Pat. Off. | 70/283 |
| 9006024 | 5/1990 | WIPO | 70/278 |

*Primary Examiner*—Darnell M. Boucher
*Attorney, Agent, or Firm*—Swabey, Ogilvy, and Renault

[57] ABSTRACT

A safe door lock with a servo motor operated cam is described. A retracting lever is pivotally secured to the locking bolt and is displaced on a pivot connection with the bolt by the cam. The position of the cam and the bolt are detected by microswitches. When the retracting lever is in a locking position, the bolt cannot be retracted within the lock housing. The cam is operated by a servo motor and locked in position by the gear train which includes a worm gear. The locking bolt may be a slam bolt having a spring biased latch which slides therewith or the locking bolt may be a deadbolt when the lock is used with a boltwork system of a vault door.

16 Claims, 9 Drawing Sheets

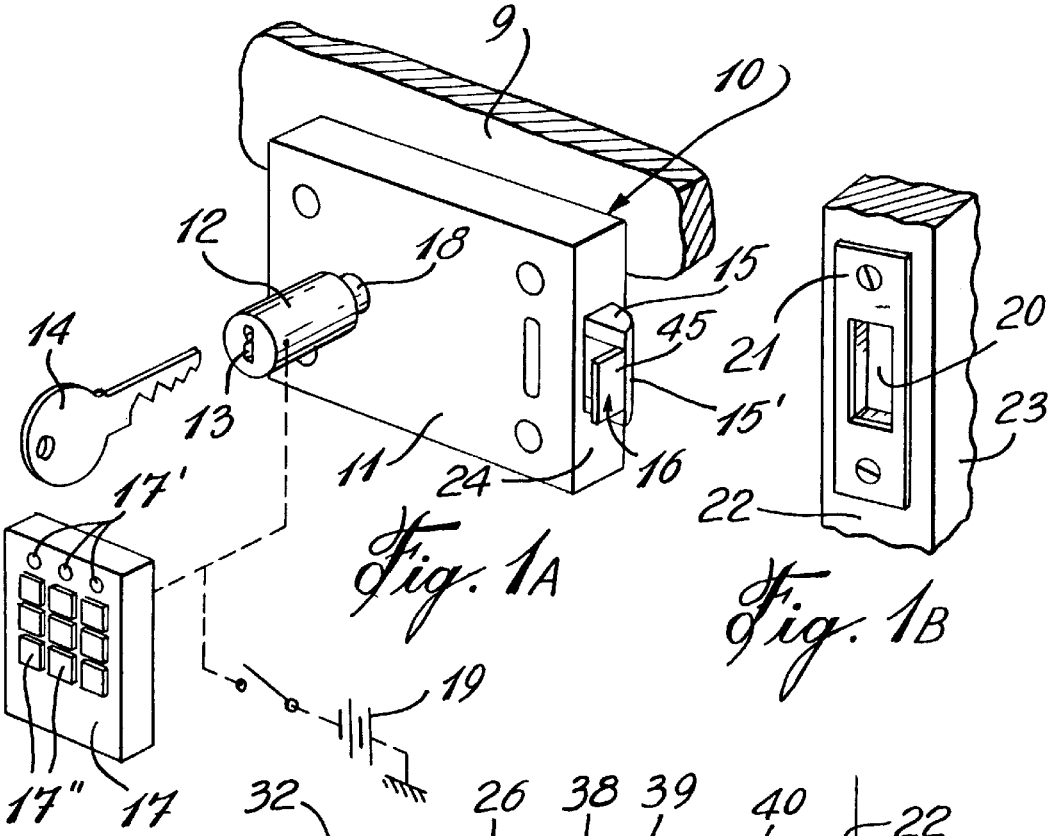
Fig. 1A
Fig. 1B
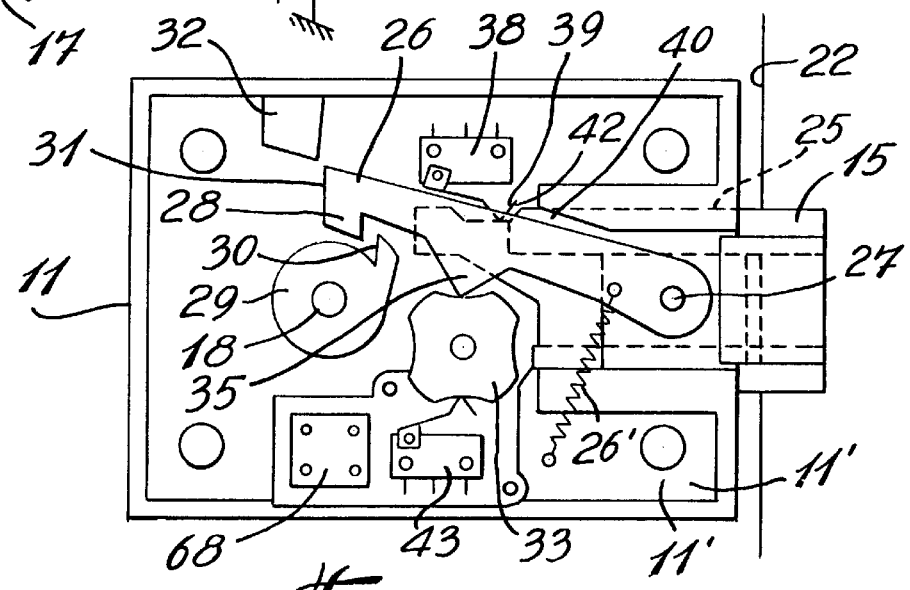
Fig. 2

SAFE DOOR LOCK WITH SERVO MOTOR OPERATED CAM

TECHNICAL FIELD

The present invention relates to a safe door lock which may be used with a slam bolt latch combination or with a deadbolt lock and wherein the lock incorporates an automatically controlled, self-locking, motor-operated cam.

BACKGROUND ART

Various automatic door locks are known for locking doors of safes and incorporate therein timing mechanisms. The majority of these locks are combination locks wherein it is necessary to punch in a code via a keypad or use special keys or tumbwheels in order to actuate a timer and/or to disengage the internal locking mechanism whereby to permit a user to retract the lockbolt by means of a lever or otherwise in order to have access to the safe. Some of these locks, however, have disadvantages in that they are bulky, are unreliable and require frequent maintenance, are not suitable for slam bolt or deadbolt use and their locking mechanism can be easily disabled by burglars.

SUMMARY OF INVENTION

It is a feature of the present invention to provide a safe door lock which substantially overcomes the above-mentioned disadvantages of the prior art and which can be used with a slam bolt and latch or with a deadbolt.

Another feature of the present invention is to provide a safe door lock which is compact and which utilizes a self-locking servo motor operated cam to place the lock in a lock or unlock condition.

Another feature of the present invention is to provide a safe door lock which has a reliable locking mechanism and which may be provided with secondary locking means for locking the retracting lever and with a secondary bolt locking pin which is engaged if the cover of the lock housing is removed.

Another feature of the present invention is to provide a compact safe door lock which may be operated by a switch, a key cylinder or by a keypad.

According to the above features, from a broad aspect, the present invention provides a safe door lock which comprises a lock housing. A spring biased locking bolt is slidingly retained in a guide means in the housing. The locking bolt has a bolt end extending from an edge wall of the housing to secure a safe door in a door jamb of a safe. A retracting lever is pivotally secured at a pivoting end to the bolt internally of the housing. The retracting lever has engageable means for retracting the lever. Retraction means is engageable with the engageable means to retract the bolt into the housing. Sensing switch means is provided to detect the position of the bolt. Arresting means is further provided to prevent retraction of the lever and bolt into the housing and to maintain the bolt in a locked position. A motor driven cam is provided in the housing and co-acts with a cam follower means of the lever to displace the lever on the pivoting end to position the engageable means of the lever at a retractable position or at a locked position associated with the arresting means. Cam position detection means is provided to detect the position of the cam. Signaling means is provided to displace the cam to a lock opening position. Means is also provided to arrest the cam at the retractable position or at the locked position of the lever.

BRIEF DESCRIPTION OF DRAWINGS

A preferred embodiment of the invention will now be described with reference to the accompanying drawings in which:

FIG. 1A is a perspective view of the safe door lock housing and incorporating a slam bolt and latch combination;

FIG. 1B s a fragmented perspective view showing a keeper plate which is secured in a safe door jamb and for use with the lock of FIG. 1A;

FIG. 2 is a simplified side view showing the lock mechanism;

DESCRIPTION OF PREFERRED EMBODIMENTS

Figure 3:
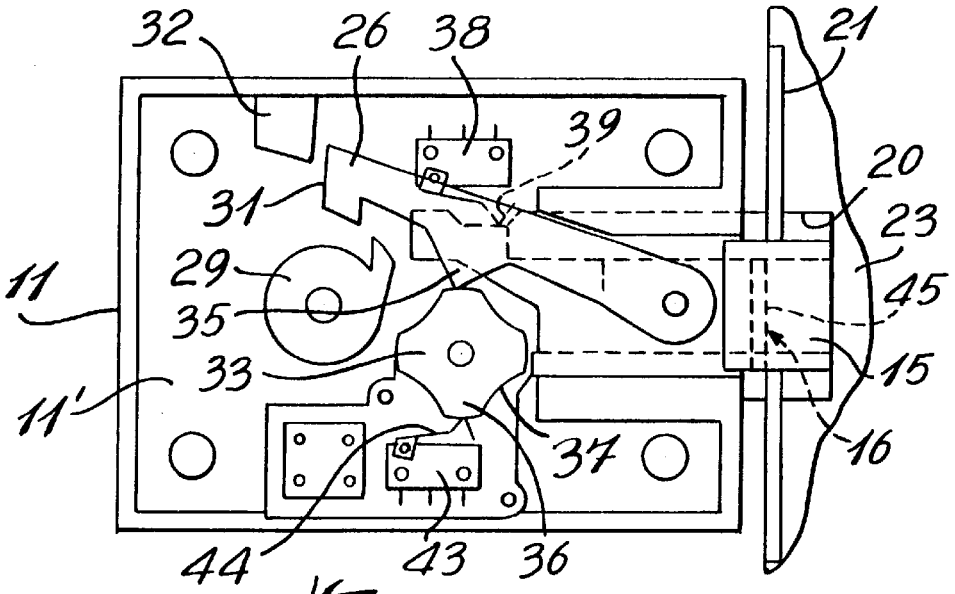
FIGS. 3, 4 and 5 are side views, similar to FIG. 2, showing the operation of the lock mechanism.

Referring now to the drawings and more particularly to FIGS. 1A and 1B, there is shown generally at 10 the safe door lock of the present invention and comprising a lock housing 11 to which is secured a lock cylinder 12 provided with a keyway 13 for receiving a key 14 therein in order to turn the lever retracting rod 18 to retract the sliding slam bolt 15 and its latch plate 16 whereby to permit a door of a safe (not shown) to be open. A keypad 17 may be associated with the safe and provided at a suitable location whereby to place the locking mechanism inside the housing in a condition to permit the locking bolt 15 and sliding latch plate 16 to be retracted. It is pointed out that instead of a lock cylinder 12 a simple handle may be provided to rotate the retracting rod 18. A switch 19 may also be provided and may co-act with a timer circuit, whereby to condition the locking mechanism to place it in a bolt retracting mode after a suitable time delay whereby the bolt may be retracted. As shown in FIG. 1B, the bolt 15 is normally secured in a bolt hole 20 of a keeper member 21 which is secured in the side wall 22 of the door jam 23 of a safe.

Referring now to FIGS. 2 to 5, it can be seen that the locking bolt 15 has an engageable bolt end 15' which extends from the edge wall 24 of the lock housing 11. The bolt is slidingly retained in guide slots 25 formed integral with the side wall 11' of the housing. A retracting lever 26 is pivotally secured at a pivoting end 27 to the sliding bolt 15 and internally of the housing 11. The lever 26 is biased downwardly by a helical spring 26'. The retracting lever 26 is provided with engageable means in the form of a projecting tooth 28 to permit the lever 26 and bolt 15 to be retracted within the housing, as will be described later.

Figure 4:
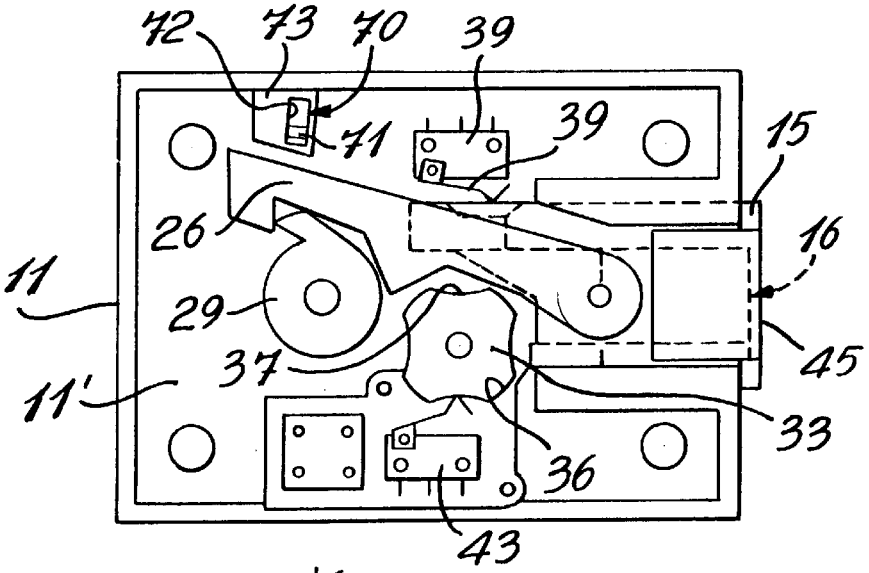

Retraction means in the form of a disc 29 having a retracting finger 30 projecting from the periphery thereof is secured to the retracting rod 18 and when rotated engages the projecting tooth 28, when the lever is lowered to a retracting position, as shown in FIG. 2 whereby to retract the bolt 15 within the housing, as shown in FIG. 4.

Figure 6A:
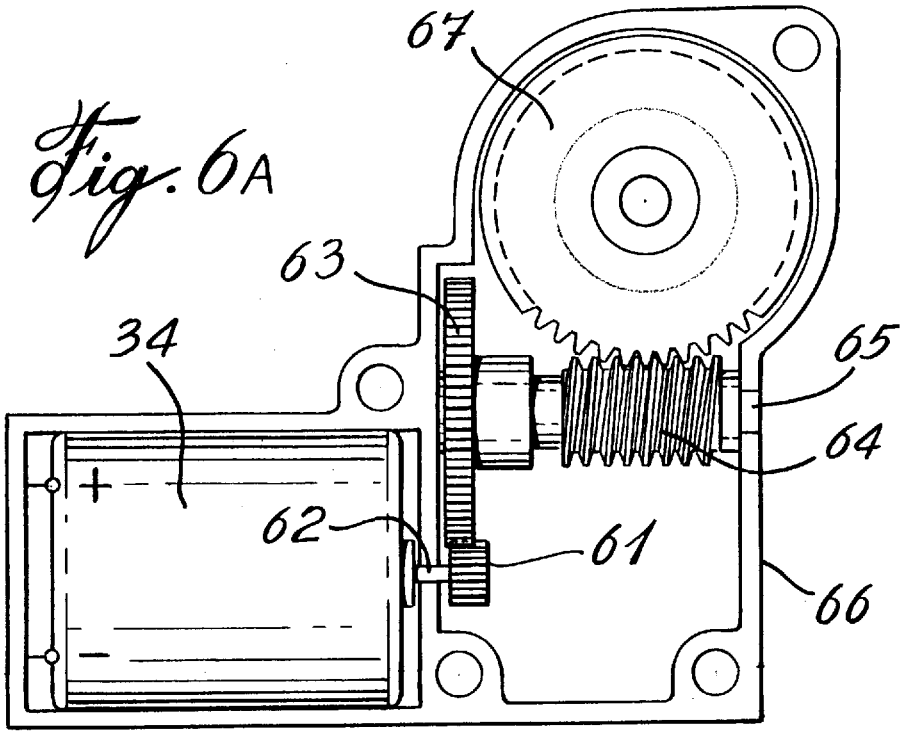
FIG. 6A is a side view showing the gear train associated with the servo motor for driving the cam.
Figure 6B:
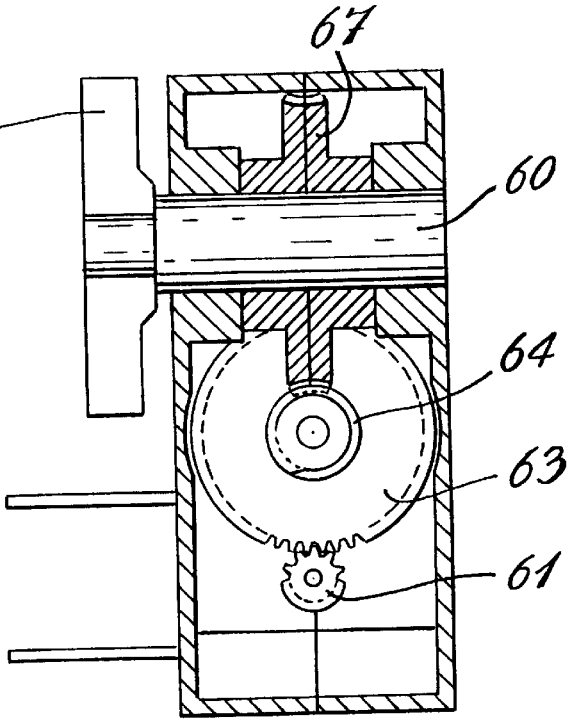
FIG. 6B is an end view of FIG. 6A.
Figure 7:
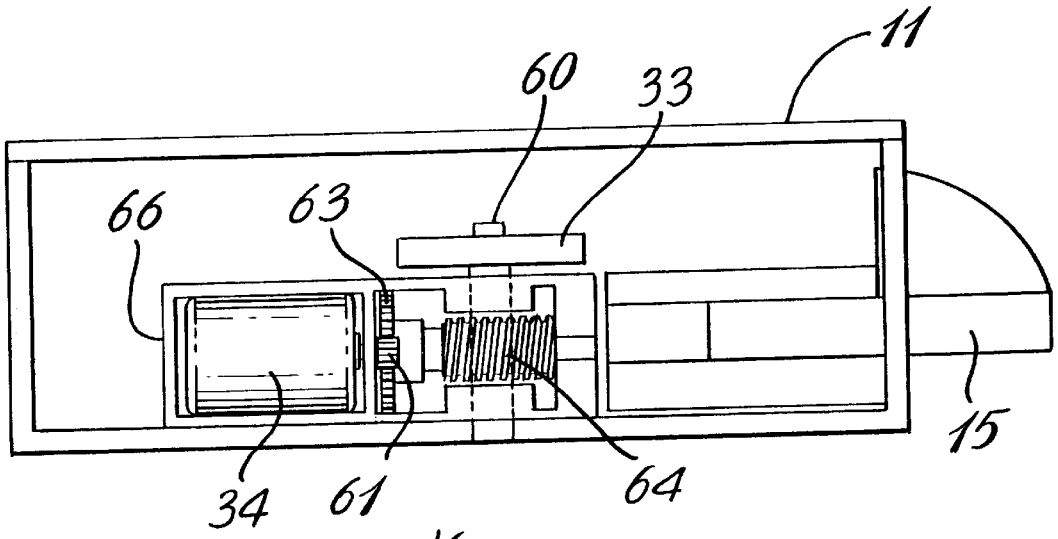
FIG. 7 is a top view showing the disposition of the servo motor and gear train with respect to the cam.

FIG. 3 illustrates the lock mechanism in a lock condition wherein the retracting lever 26 is pushed up to its locked position with the forward arresting end 31 of the lever having a portion thereof disposed adjacent an arresting post 32 which may be formed integral with the side wall 11' of the housing 11. A motor driven cam 33 is actuable by a servo motor 34, (see FIGS. 6A, 6B and 7) and co-acts with a projecting finger formation 35 formed integral in a lower edge of the retracting lever 26 and disposed in frictional contact with the peripheral edge of the cam 33. As can be seen, the cam 33 is formed as a disc and as hereinshown the disc has four diagonally opposed projecting formations 36 and intermediate cavitated formations 37 disposed thereabout whereby to displace the lever to a locked position, as shown in FIG. 3, or to an unlocked position, as shown in FIG. 2. Accordingly, by displacing the cam through an angle of 45 degrees, the lever is displaced to its engaged or disengaged position. It is also foreseeable that the cam may have only two formations and that the position thereof be controlled by the servo motor and a timer circuit and switches.

Sensing switch means in the form of a microswitch 38 is secured to the side wall 11' of the housing 11 to one side of the bolt 15 whereby to detect the position of the slam bolt 15. The microswitch 38 has a pivoting switch arm 39 which is normally biased in an open position, as shown in FIG. 2 and is displaceable upwardly to a closed position, as shown in FIG. 4, when the bolt 15 is retracted within the housing. This displacement is achieved by a projecting switch actuating finger 40 formed integral with the rear end of the bolt and projects rearwardly thereof. The finger 40 has a beveled edge 41 to engage the forward upturned edge 42 of the switch arm 39 when the bolt is retracted to displace the switch arm 39 upwardly, and to support it at this position on the upper edge 40' thereof, as shown in FIG. 4. A further microswitch 43, also provided with a pivotal switch arm 44, is disposed adjacent the cam 33 whereby the switch arm 44 senses the projecting formation 36 or the cavitated formation 37 to detect the position of the cam and hence the position of the retracting lever. This in turn signals visual indicating means in the form of lights 17' provided on the keypad 17 or elsewhere indicating the condition of the lock.

With further reference to FIGS. 9 to 14, there is shown the construction of the slam bolt 15 as well as the spring biased latch member 16. The latch member is formed from a flat metal piece and has a keeper engaging end 45 formed as a right angle flange extending into the rectangular body 46. A switch engaging tail end 47 is formed integrally at the opposed end of the rectangular body 46 and co-acts with the microswitch pivotal switch arm 39, as will be described later, to provide a signal generated by the light 17' to indicate that the slam bolt 15 is extended to an engaged position within the bolt hole 20 of the keeper plate 21.

The latch member 16 is retained captive in a slot 48 formed within a side wall 49 of the slam bolt and is spring biased externally of the lock housing by means of a spring 50 which is located in a spring retaining cavity 51 formed in the slot side wall 52 and engaging a spring contacting guide flange 53 punched out of the rectangular body 46 of the latch plate or otherwise secured thereto. This guide flange 53 extends within the spring retaining cavity 51. The latch plate member 16 is also provided with a through slot 54 through which an arresting pin 55 extends to limit the sliding displacement of the latch plate with respect to the slam bolt.

Figure 9:
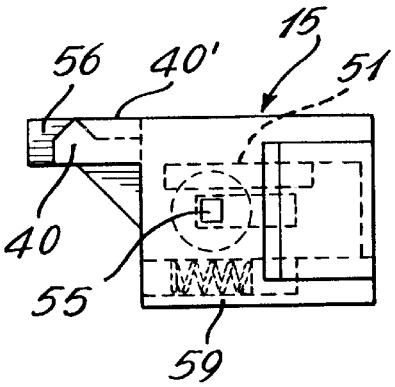
FIG. 9 is a side view of the slam bolt and showing the position of the latch plate with respect thereto.

The tail end portion 47 of the latch plate 16 is provided with a straight switch arm support edge 56 which lies in a common plane with the switch arm support edge 40' of the switch actuating finger 40 of the slam bolt, as shown in FIG. 9. This tail end portion 47 of the latch member will maintain the pivotal switch arm 39 of the microswitch 38 displaced upwards to a closed position, as shown in FIG. 4, when the bolt end 15 is extended out of the edge wall 24 of the switch housing and the door 9 to which the lock 10 is secured is open whereby the bolt is out of the bolt hole 20 of the keeper plate 21 and at the same time the latch plate is spring biased away from the end wall 24 of the lock housing, as shown in FIG. 1A. This condition provides a signal that the bolt is extended out and that the safe door 9 is in an open position. The tail end 47 of the latch plate is also provided with a recessed section 57 adjacent the switch arm support edge 56 to maintain the switch arm 39 of the microswitch 38 in an open condition when the latch plate is biased inside the housing, as shown in FIG. 3, when the door is closed with the bolt extending into the bolt hole 20 of the keeper plate 21 and the keeper engaging end 45 abuts against the keeper plate 21 to one side of the bolt hole 20, as shown in FIG. 3.

Figure 8:
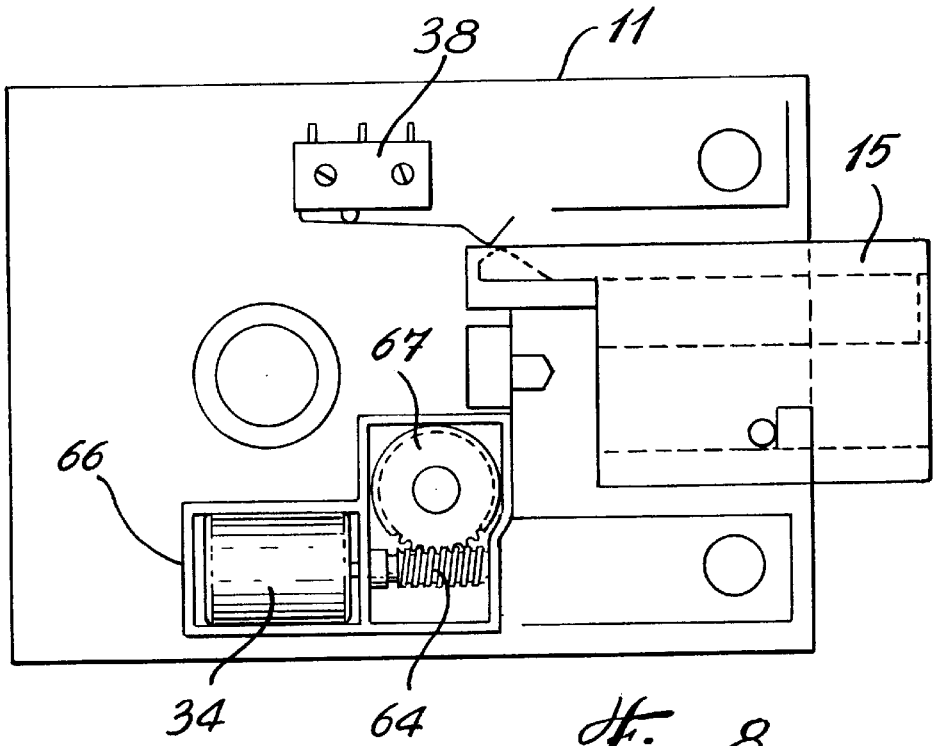
FIG. 8 is a side view showing the position of the servo motor a gear train with respect to the lock housing.

In order to prevent the cam 33 from being rotated by piercing a hole through a removable cover (not shown) of the lock housing there is provided means to arrest the cam 33 at any position thereof and particularly at its locked position as shown in FIG. 3. This arresting means will now be described with reference to FIGS. 6A to 8 and is provided by the gear train which connects the servo motor 34 to the support shaft 60 of the cam 33. As shown in these Figures, the pinion gear 61, which is connected to the drive shaft 62 of the servo motor 34 is in toothed engagement with a gear wheel 63 which rotates a worm gear 64. The worm gear 64 is supported on a stationary axle 65 in the gear housing 66. The worm gear 64 is also in axial toothed engagement with a further toothed drive wheel 67 which is connected to the support shaft 60 of the cam 33. Accordingly, the worm gear 64 will not rotate if the cam is forced due to its gear coupling with the toothed drive wheel 67 which is disposed co-extensively therewith and transverse to the gear wheel 63, as can be appreciated by analyzing FIGS. 7 and 8. The gear train arrangement also makes it possible to provide a compact housing design for the servo motor within the small lock housing 11.

As shown in FIG. 2, the lock is further provided with a timer circuit 68 conveniently packaged therein and connected to the keypad 17 or switch 19 to provide programmed time delays before the cam 33 is caused to operate to position the lock retrieving lever 26 to an open retractable position, as shown in FIG. 2. The timer circuit 68 may also be programmed to have a reclosing time sequence whereby to provide a signal after a certain time delay and an open window of time within which the safe door may be left open. If the door is not closed within that time window, then an alarm, either visual or audible, can be activated to signal to the user of the fault.

Figure 5:
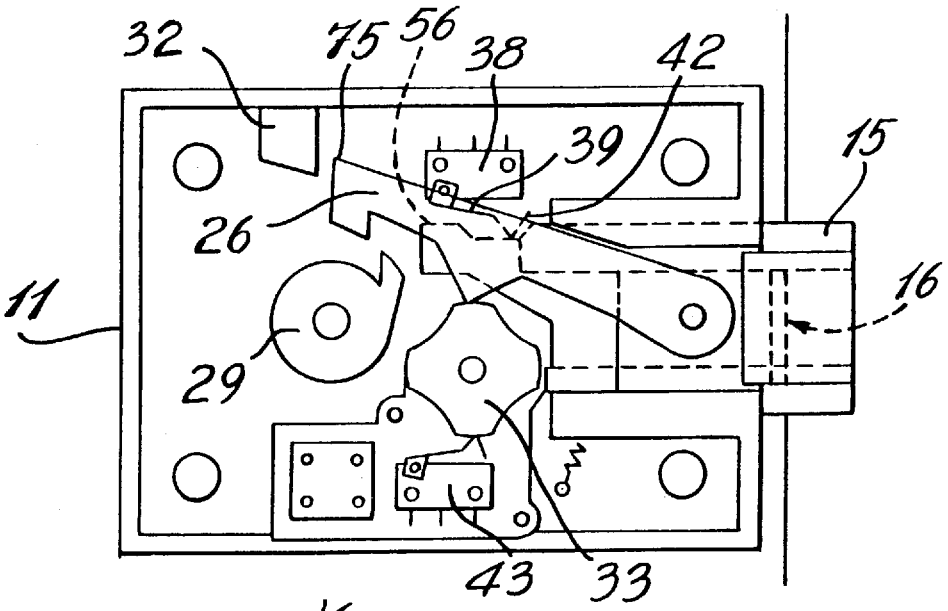
Figure 15:
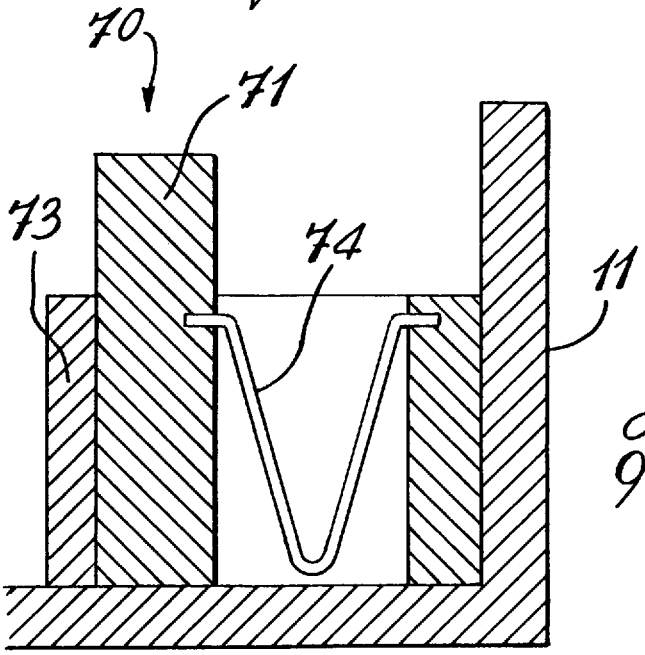
FIG. 15 is a cross-section view of the spring-biased abutment member as seen along cross-section lines XV—XV of FIG. 18.

In FIGS. 4 and 15, there is shown another embodiment of the arresting means to prevent the lever 26 from being retracted when in a closed position. As hereinshown, and better illustrated in FIG. 15, the arresting means is provided by a spring bias arresting post. The post 71 is retained captive within a housing 73 and retained therein by a connecting V-shaped leaf spring 74 which biases the arresting post to its position as shown in FIGS. 4 and 15. The reason for this spring bias arresting post 71 is that when the lever arm 26 is returned to its locked position, as shown in FIG. 5, the forward projecting end 75 of the lever may strike the arresting post 71 and because it is spring biased, the post will move upwardly and then immediately reset to its obstructing arresting position. This spring bias arresting post is less troublesome and preferred from a solid arresting post 32, as shown in FIG. 3.

Briefly summarizing the operation of the lock mechanism as illustrated in FIG. 1 to 5 by actuating a signaling means either by depressing the keys 17" on the keypad 17 to punch in a recognizable code or by actuating a switch 19, the servo motor 34 is caused to operate for a predetermined period of time as detected by the switch 43, and timer circuit 68 if there is a time delay, whereby the cam 33 will turn through a 45 degree arc causing it to turn from its position as shown in FIG. 3, where the retracting lever is in a raised engaged position, to its position as shown in FIG. 2, where the retracting lever is in a lowered disengaged, retracting position. By inserting a key, such as a key 14, in the key cylinder 12 or by turning a handle (not shown) which is connected to the retracting rod 18, the retracting disc 29 is rotated engaging the retracting lever 26 and retracting the bolt 15 within the housing. As the bolt is retracted, the projecting finger 40 of the bolt engages the switch arm 39 causing an indication that the bolt is retracted. When the safe door is engaged, the latch plate is in its position as shown in phantom line at FIG. 2. FIG. 4 indicates the bolt in its retracted position and the lever engaged by the retracting disc 29. The timer circuit 68 is placed in operation as soon as the microswitch 38 is closed. The user now has access to the safe for a predetermined time limit. If that time limit is exceeded, an audible and/or visual alarm is triggered.

Figure 10:
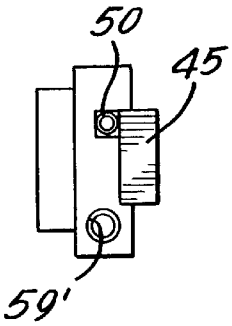
FIG. 10 is an end view of the latch bolt and also showing the position of the latch plate with respect thereto.
Figure 11:
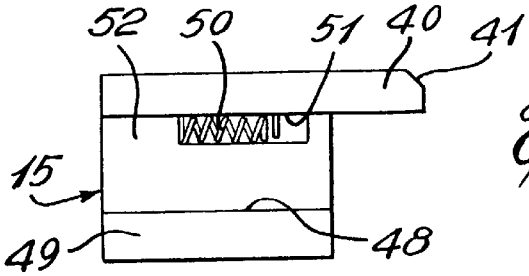
FIG. 11 is the opposed side view of the bolt.
Figure 12:
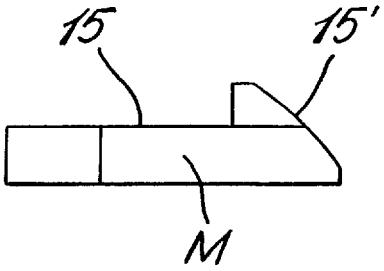
FIG. 12 is a top view of the bolt.
Figure 13:
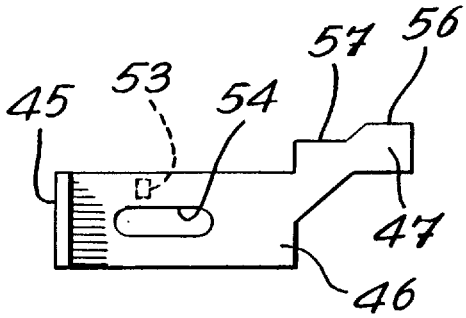
FIG. 13 is a side view of the latch plate.
Figure 14:
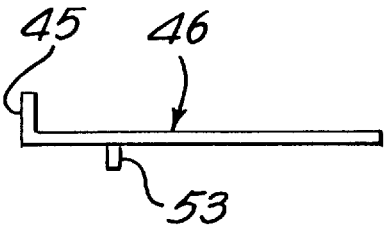
FIG. 14 is a top view of the latch plate.

When the door is closed, the retracting disc 29 is released and the bolt is spring biased to its engaged position by means of a helical spring 59 secured within the spring locating bore 59 machined within the bolt 15 as shown in FIGS. 9 and 10. When the bolt projects within the bolt hole 20 of the keeper plate 21 the keeper engaging end 45 of the latch plate abuts against the keeper plate and therefore remains substantially in its position as shown in FIGS. 1 to 5 and more clearly in FIG. 5, extended with the housing, with the switch arm 39 of microswitch 38 being in an open switch position. It is only when the bolt is released with the door opened, that the keeper plate will move out of the housing, as shown in FIG. 1A, to cause a switch closure by displacing a switch arm 39 upwardly when engaged by the support edge 56 of the latch plate and thus again causing a visual light indication. The bolt can then be retracted if the cam has not changed position. After the predetermined time delay, the servo motor is again operated and the cam moves the lever to its engaged position. If the retracting disc 29 is still engaged with the retracting lever, the lever arm will still move up if the arresting means is a spring bias arresting post 71 as shown in FIG. 15 and this will cause the bolt retracting lever to be released from the retracting disc 29.

Figure 16:
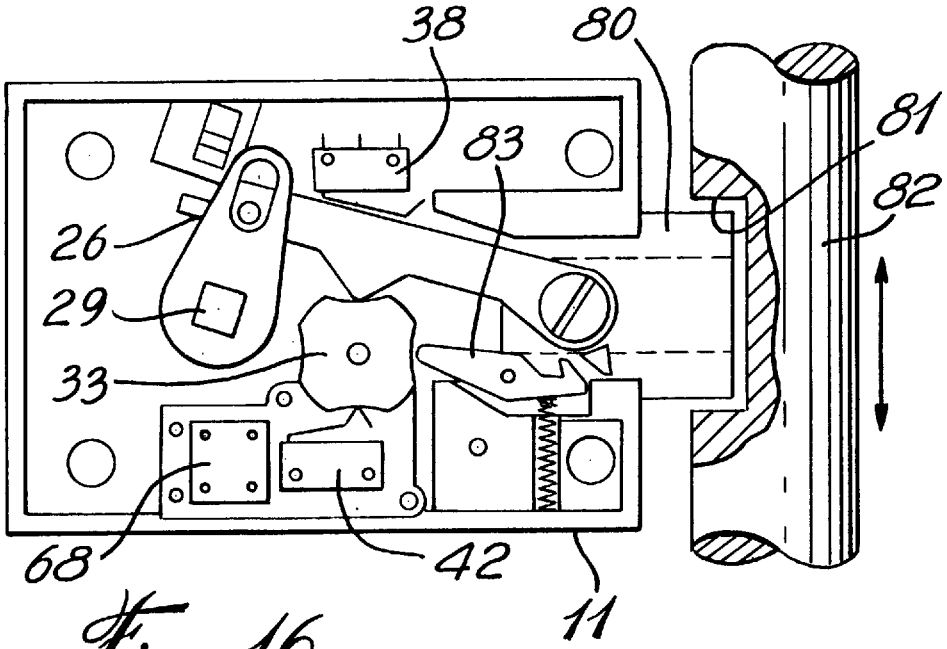
FIG. 16 is a side view of the lock housing in a deadbolt application and illustrating a locking rod of a boltwork system associated therewith.
Figure 17:
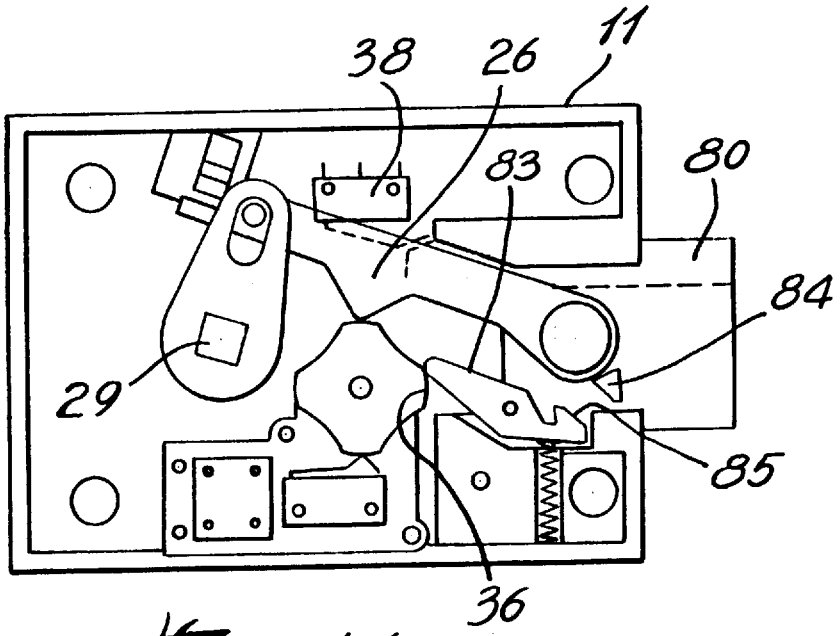
FIGS. 17 and 18 are side views of the lock, similar to FIG. 16, and showing the bolt and the retracting lever in a locked and unlocked position.
Figure 18:
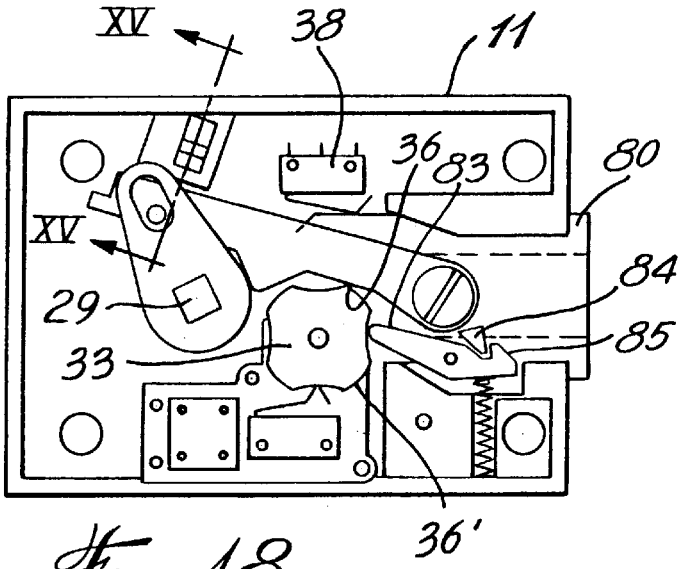

Referring now to FIGS. 16 to 18, there is shown a further modification of the lock mechanism. As hereinshown, the locking bolt is modified to form a deadbolt 80 which is usually formed with a rectangular projecting head. Such a lock may, for example, be secured in a boltwork system of a vault door and wherein the deadbolt, when extended to a lock position, as shown in FIG. 16, engages in a lock rod cavity 81 of a lock rod 82 associated with the boltwork (not shown but obvious to a person skilled in the art). As hereinshown the deadbolt 80 is further provided with bolt retention means in the form of a pivoting spring biased catch 83 which is secured to the lock housing 11 and which provides for releasable engagement with a retention post 84 which may be formed integral with the side wall of the bolt 80. The spring biased catch 83 has an engaging head 85 and when the bolt is retracted, the head springs down and engages with the retention post 84 to retain the bolt captive in a retracted position within the lock housing. Such a condition is shown in FIG. 18 where the cam was rotated to disengage the retracting lever. Accordingly, the bolt is retained retracted until such a time as the cam 33 is caused to rotate in a counterclockwise direction. As soon as the cam 33 starts to rotate to place the projecting cam formation 36 upwards, the cam formation 36' will frictionally engage the end portion of the pivoting spring biased catch 83 and push it upwardly causing the catch to pivot on the retaining pin to disengage the head 85 from the retention post 84 (as shown in FIG. 17) and releasing the bolt under the action of the spring force of spring 59. The cam may also be operated by a switch which is controlled by a user person and operable only by punching a code in the keypad.

Figure 19A:
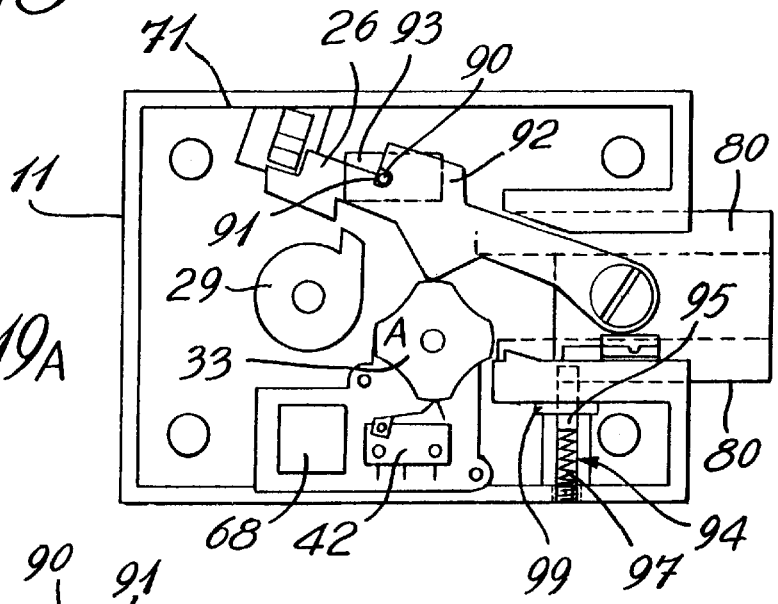
FIGS. 19A to 19D are side views of the lock mechanism showing secondary locking means associated with the retracting lever and with the sliding bolt.
Figure 19B:
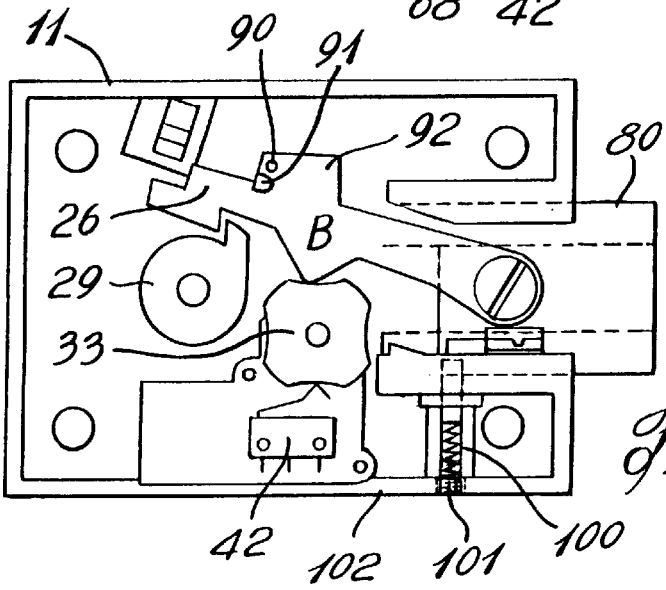
Figure 19C:
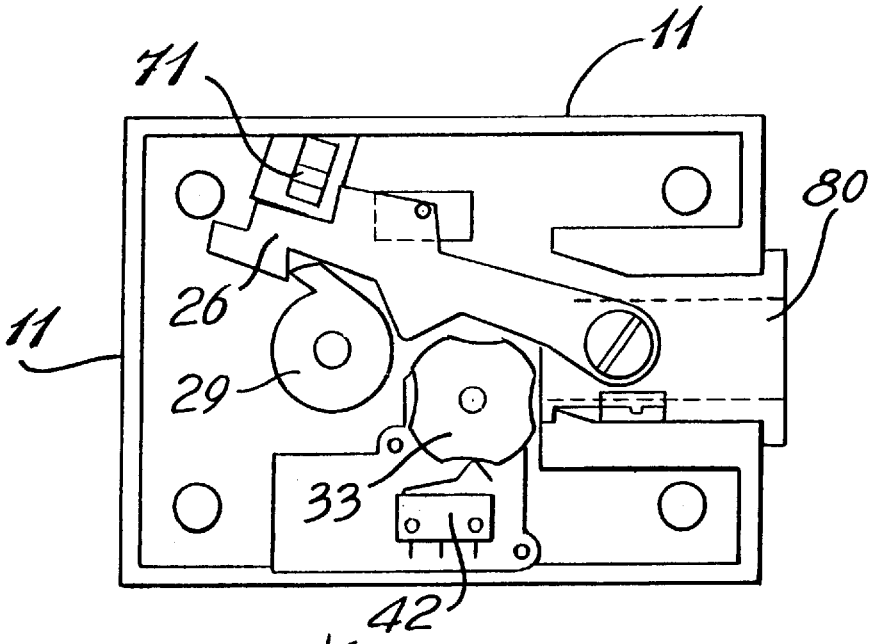
Figure 19D:
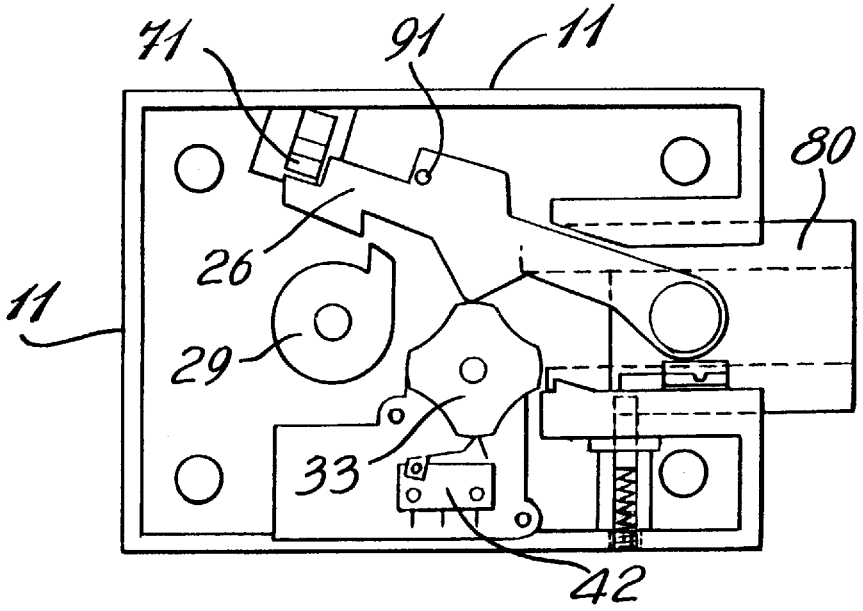

Referring now to FIGS. 19A to 19D, there is shown a further safety feature that may be incorporated in the locking mechanism of the safe door lock 10 of the present invention. As hereinshown there is provided a secondary releasable locking means for locking the retracting lever 26 when at its locked position as shown in FIG. 19A. As hereinshown the secondary releasable locking means is provided by a solenoid rod 90 which is engageable within a lock bore 91 formed within an enlarged portion 92 of the retracting lever 26. The solenoid rod 90 projects from the solenoid cylinder housing 93 and is retracted to disengage from the lock bore 91 within a short time delay before the servo motor is caused to be operated by a signal from the keypad indicating that the lock should be positioned to an open condition. Similarly, within a short time delay after the retracting lever 26 is at its locked position, the solenoid rod is extended to enter into the lock bore. As hereinshown, the forward end portion of the lever has also been modified to co-act with the arresting post 71 when positioned to its locked position.

FIG. 19A shows a further secondary lock means for the bolt 80 or 15 to prevent the bolt from being retracted should a cover of the lock housing 11 be removed. As hereinshown a bolt locking means 94 is constituted by a spring bias lock pin 95 which is guided in a bore 96 and spring biased by helical spring 97 towards the deadbolt 80 or latch bolt 15. A notch 98 or a cavity is formed in the lower edge 80' of the bolt whereby to permit the pin 95 to enter therein to prevent further movement of the bolt into the housing. The cover of the housing (not shown) is provided with a flange 99 which extends into a flange slot 100 and arrests the pin 95 in a spring bias condition. This bolt and spring are positioned into the housing after assembly through a hole sealed by a screw 101 provided in the lower edge 102 of the housing 11. The screw 101 may be sealed therein with a compound or otherwise. When the cover is removed, the plate 99 is retracted and the pin released under its spring load to engage the bolt and this action and bolt is concealed within a solid mass of the lock housing.

It is within the ambit of the present invention to cover any obvious modifications of the examples of the preferred embodiment described herein, provided such modifications fall within the scope of the appended claims.

We claim:

1. A safe door lock comprising a lock housing, a spring biased slam-type locking bolt slidingly retained in a guide means in said housing, said locking bolt having a bolt end extending from an edge wall of said housing to secure a safe door in a door jamb of a safe, a retracting lever pivotally secured at a pivoting end to said bolt internally of said housing, said retracting lever having engageable means for retracting said lever, retraction means engageable with said engageable means to retract said lever and said bolt into said housing, sensing switch means to detect the position of said bolt, arresting means to prevent retraction of said lever and bolt into said housing and to maintain said bolt in a locked position, a motor driven cam in said housing and co-acting with a cam follower means of said lever to displace said lever on said pivoting end to position said engageable means of said lever at a retractable position or at a locked position associated with said arresting means, cam position detection means to detect the position of said cam, signaling means to displace said cam to a lock opening positions, means to arrest said cam at said retractable position or at said locked position of said lever, a spring biased latch member slidingly retained adjacent said bolt for limiting sliding displacement in and out of said housing from said edge wall thereof, said latch member having a keeper engaging end disposed externally of said housing and a switch engaging tail end portion internally of said housing and co-acting with said sensing switch means to detect if said bolt end is disposed in a keeper plate bolt hole, said lever being spring biased against said cam, said bolt having a projecting switch actuating finger in a rear portion thereof co-acting with said sensing switch means whereby said sensing switch means can detect the position of said bolt, said cam having a disc with at least two formations formed about a peripheral edge thereof, said cam follower being disposed in sliding frictional contact with said peripheral edge, one of said formations being a lever locking formation and the other of said formations being a lever unlocking formation.

2. A lock as claimed in claim 1 wherein said sensing switch means is a microswitch having a switch arm, said switch arm being normally biased in an open position, said switch arm being displaced to a closed position by said switch actuating finger of said bolt when retracted in said housing by said retraction means when engaged with said engageable means of said retracting lever.

3. A lock as claimed in claim 2 wherein said switch engaging tail end portion of said latch member is an enlarged end portion having a switch arm support edge lying in a common plane with a switch arm support edge of said switch actuating finger, said switch arm being displaced to said closed position when said bolt end is extended out of said edge wall and out of said bolt hole of said keeper plate when a safe door is in an open condition for access to the interior of a safe.

4. A lock as claimed in claim 1 wherein said arresting means is an abutment member secured to said housing, said bolt having an abutting end edge which is disposed in obstructing relationship with said abutment member when said retracting lever is disposed to said locked position by said cam.

5. A lock as claimed in claim 4 wherein said abutment member is a stationary structural abutment wall formed integral with said housing.

6. A lock as claimed in claim 4 wherein said abutment member is a spring biased abutment member capable of being displaced by a portion of said abutment end edge of said retracting lever when disposed to said locked position by said cam.

7. A lock as claimed in claim 1 wherein said engageable means of said retracting lever is a projecting element, said retraction means having a displaceable finger engageable with said projecting element to retract said retracting lever.

8. A lock as claimed in claim 7 wherein said projecting element is a projecting finger formation formed integral with said retracting lever and projecting from a lower edge thereof.

9. A lock as claimed in claim 7 wherein said retraction means is a disc having said finger extending from a peripheral edge thereof, said disc being secured on an axially rotatable rod, said rod having a portion projecting out of a sidewall of said housing, and means to impart rotation to said rod to retract said bolt when said lever is positioned at said retractable position by said cam.

10. A lock as claimed in claim 9 wherein said means to impart rotation to said rod is a key when placed in a keyway of a lock cylinder secured to said portion of said rod projecting out of said sidewall of said housing.

11. A lock as claimed in claim 1 wherein there are four diagonally opposed ones of said one and other formations about said cam disc.

12. A lock as claimed in claim 1 wherein said cam disc is secured to a drive shaft, a gear train including a worm gear interconnecting said drive shaft to a servo motor.

13. A lock as claimed in claim 12 wherein said means to arrest said cam is constituted by said gear train, said worm gear being connected to a gear wheel in toothed engagement with a pinion gear at an output shaft of said servo motor, said worm gear being in axial toothed engagement with a toothed drive wheel secured to said drive shaft of said cam.

14. A lock as claimed in claim 1 wherein said cam position detection means is a spring biased switch arm of a microswitch in frictional displaceable engagement with said peripheral edge of said cam disc to sense the position of said formations.

15. A lock as claimed in claim 1 wherein said signaling means to displace said cam to a lock opening position is a keypad having coding means to permit actuation of switching means to cause rotation of a servo motor connected to said cam upon entry of a digital code, and visual indication means on said keypad to indicate the condition of said lock.

16. A lock as claimed in claim 15 wherein there is further provided timer circuit means associated with said keypad to provide time delays before said retraction means may be operable and further time delays for the reclosing of said safe door, said timer circuit means being associated with said visual indication means.

* * * * *